US006554285B2

(12) United States Patent
Chittenden

(10) Patent No.: US 6,554,285 B2
(45) Date of Patent: Apr. 29, 2003

(54) DISC GOLF TARGET

(76) Inventor: Fred C. Chittenden, 2012 Grade Rd., Suite 201, Lake Stevens, WA (US) 98258

( * ) Notice: Subject to any disclaimer, the term of this patent is extended or adjusted under 35 U.S.C. 154(b) by 0 days.

(21) Appl. No.: 09/887,900

(22) Filed: Jun. 21, 2001

(65) Prior Publication Data

US 2001/0033057 A1 Oct. 25, 2001

Related U.S. Application Data

(63) Continuation-in-part of application No. 09/317,352, filed on May 24, 1999, now Pat. No. 6,250,635.

(51) Int. Cl.[7] ..... A63B 67/06
(52) U.S. Cl. ..... 273/400; 473/476
(58) Field of Search ..... 273/398–402; 473/476, 479

(56) References Cited

U.S. PATENT DOCUMENTS 4,039,189 A 8/1977 Headrick
4,084,812 A 4/1978 Melrose et al.
4,461,484 A 7/1984 Headrick
4,809,988 A 3/1989 Hunter
5,358,255 A 10/1994 Jolson
5,452,903 A 9/1995 Larrabee
5,868,395 A 2/1999 Headrick
5,893,563 A 4/1999 Buller
5,921,551 A 7/1999 Dunipace
6,250,635 B1 * 6/2001 Chittenden ..... 273/400

* cited by examiner

*Primary Examiner*—Mark S. Graham
(74) *Attorney, Agent, or Firm*—Todd N. Hathaway

(57) ABSTRACT

A disc golf target assembly. A plurality of chain segments are suspended from a support member by generally U-shaped attachment loops. The attachment loops have upwardly and outwardly sloped side portions, so that the energy of the disc is absorbed and dissipated by spreading and lifting the chain segments as the disc strikes the target assembly. The support member, attachment loops and chain segments may be mounted on a vertical support, and the assembly may include a basket that is mounted beneath the support and chain segments for receiving the disc therefrom.

19 Claims, 5 Drawing Sheets

DISC GOLF TARGET

This is a continuation-in-part-of application Ser. No. 09/317,352, filed May 24, 1999, now U.S. Pat. No. 6,250,635.

BACKGROUND OF THE INVENTION a. Field of the Invention

The present invention relates generally to a playing apparatus for disc golf games, and, more particularly, to a disc golf target having an improved structure for intercepting and capturing a disc that is directed at the target.

b. Related Art

Disc golf is an increasingly popular game in which plastic discs (somewhat similar to the discs sold under the trademark "FRISBEE") are directed at a series of targets that are arranged to form a "course". The game is played according to rules that correspond roughly to those for conventional golf, and the course if often laid out in and around trees and other obstacles so as to present an increased challenge. Thus, the object is usually to start at a specified point and work towards the target, attempting to place the disc in the target with the least number of throws.

While several different types of targets are in use, most have some form of basket or other receptacle which is mounted on a post or other support, often with some form of structure being mounted above the basket for intercepting the disc so that it falls into the basket. A recurring problem, however, is that the discs (which must maintain a fairly high minimum speed in order to remain airborne) tend to bounce off of this structure, so that even if the player scores a direct "hit" the disc fails to fall into the basket. In some prior designs the interception structure has been provided with a conical surface in an effort to deflect the discs into the basket, but the tendency has still been for the disc to bounce off of the structure instead of being captured.

Another disadvantage of prior types of targets is that these have generally been limited to having a single configuration. In other words, even though the targets may be arranged about a course, the targets themselves are all identical, thereby limiting the challenge to the players. For example, most prior targets have tended to be "omni-directional", in that they are designed to receive a disc that enters them from any direction. To make the course more challenging or to take advantage of certain obstacles, however, it may be desirable to configure some of the targets so that they are "directional" in nature, so that they will more readily intercept and receive a disc entering from one direction than from another.

Still further, it would be desirable in certain applications to be able to selectively re-configure individual target assemblies, so as to be able to provide a varying challenge without having to purchase additional or different target assemblies. Again, prior forms of targets generally have only a single configuration, thereby obviating any such option.

Consequently, there exists a need for a disc golf target having a structure that reduces or eliminates the problem of discs bouncing off of the target when it is properly hit. Furthermore, there exists a need for such a target that can be configured so as to be directional in nature, i.e., so that the target will more preferentially receive discs from one or more selected directions. Still further, there exists a need for such a target that can be re-configured so as to vary the challenge that is offered thereby. Still further, there exists a need for such a target which is economical to manufacture, and which is durable and long lasting in use.

SUMMARY OF THE INVENTION

The present invention has solved the problems cited above, and is a disc golf target assembly. Broadly, the assembly comprises at least first and second elongate, generally vertical members disposed to form a barrier with respect to the path of a disc, and attachment members by which upper ends of the vertical members are suspended from a support structure, each of the attachment members comprising a downwardly extending portion from which the vertical member hangs when in a static condition, and upwardly sloped side portions of which the vertical member slides in response to being struck by a disc, so that kinetic energy of the disc is absorbed and dissipated in spreading and lifting the vertical members as the disc strikes the target assembly.

The attachment members may comprise a plurality of generally V-shaped attachment loops, and the support structure may comprise an elongate rim member mounted along upper ridges of the attachment loops.

The elongate, generally vertical members may comprise a plurality of elongate, flexible members having sufficient weight to return the vertical members to the static position after being struck by a disc. The elongate flexible members may comprise a plurality of chain segments suspended from the attachment loops.

The side portions of the attachment members may comprise side portions of the attachment loops, the side portions of the attachment loops having an outward and upward curvature so that the weight of the chain segments offers increasing resistance to the disc as the chains spread further apart in response to being struck by the disc. The bottom portions of the attached members, in turn, may comprise a generally V-shaped portion of the attachment loops for centering the chain segments in the attachment loops when the chain segments are in the static position.

The elongate rim member may comprise a rim member that extends about the perimeter of a capture area. The chain segments may be suspended along the rim member so as to substantially surround the capture area. The bottom portions of the attachment loops may be angled outwardly about the perimeter of the capture area, so that the chain segments slide rearwardly along the side portions of the attachment loops and towards the capture area in response to being struck by a disc which is entering the capture area.

The elongate rim member may be a circular support member that extends continuously about the capture area. The plurality of attachment loops may be formed as a continuous structure that is mounted to the circular support member, and the continuous structure forming the attachment loops may be a bent wire rod.

The assembly may further comprise a rim member interconnecting the lower ends of the chain segments so that the chain segments extend downwardly and inwardly around the capture area.

These and other features and advantages of the present invention will be apparent from a reading of the following detailed description with reference to the accompanying drawings.

DETAILED DESCRIPTION a. Structure

Figure 1:
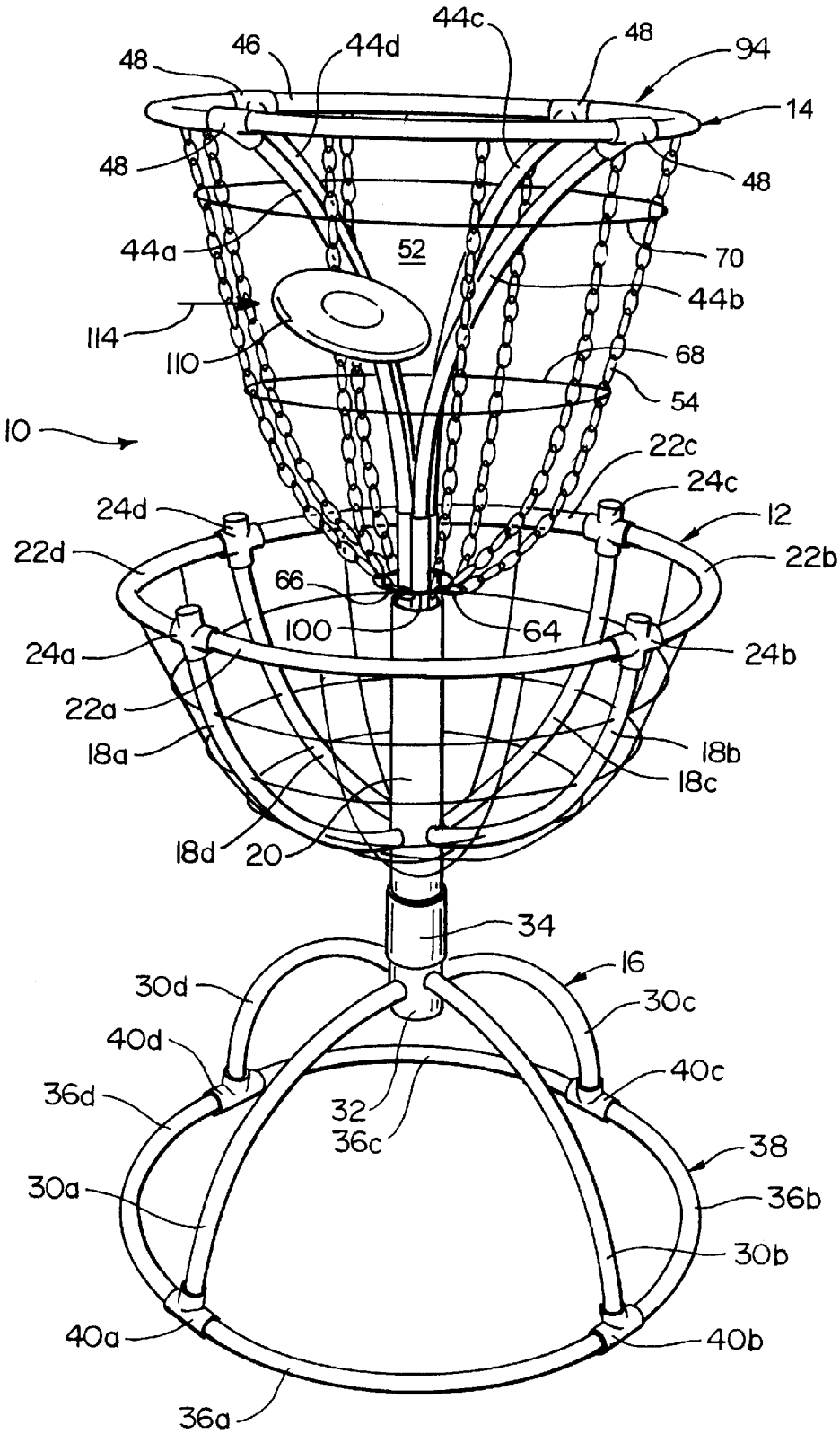
FIG. 1 is a perspective view of a disc golf target assembly in accordance with the present invention, showing the upwardly projecting structure which intercepts the disc and directs this into an underlying basket structure.

FIG. 1 shows a disc golf target 10 in accordance with the present invention. In this embodiment the target is constructed as a lightweight, portable assembly, although it will be understood that in other embodiments the target may be constructed as a permanently installed, non-portable structure. Furthermore, it will be understood that while the embodiment that is shown in the figures has the advantage of being convertible between directional and non-directional configurations, in some embodiments the invention may be constructed as a non-convertible unit.

Accordingly, the target assembly 10 in the embodiment that is shown in FIG. 1 includes a basket structure 12 and an upwardly extending interception structure 14 that are mounted on a base structure 16. The framework of the assembly is constructed principally of a plurality of tubular members mounted to one another. For example, the assembly is suitably constructed of polyurethane and/or polyvinylchloride (PVC) pipe material and associated pipefittings or, where a stronger or more permanent structure is desired, the framework can be constructed using metal tubing, such as galvanized steel pipe, for example. Accordingly, it will be understood that the terms "tube", "tubing", "tubular" and the like, as used herein, mean all such elongate members having an external configuration generally in the manner of a tube or pipe, regardless of material or whether these have a hollow or solid interior.

The configuration of the basket and support portions of the assembly can be considered somewhat optional, in that the support may be of any suitable type and the basket structure may have any suitable configuration for receiving and holding the disk after it has struck and dropped from the interception structure. However, the base and basket structure that are shown in FIG. 1 possess certain advantages in terms of portability and ease of fabrication, especially when constructed of tubular material.

Therefore, as is shown in FIG. 1, the basket structure 12 is thus suitably formed of a series of outwardly and upwardly curved tubular segments 18*a–d* which extend radially from a central pillar tube 20. The upper ends of the curved basket segments are joined to a generally circular rim that is formed of a plurality of curved, horizontally extending rim segments 22*a–d*. In the embodiment which is illustrated (which is suitably constructed of PVC/polyethylene pipe) the connections between the basket and rim segments are formed using four-way pipe connectors 24*a–d*, with an end of a basket segment being mounted to the lower end of each pipe connector and the ends of first and second rim segments being mounted to the two side arms of the connector. Moreover, where the curved segments are formed of polyethylene pipe or a similar material, a short segment or "nipple" of PVC pipe may be inserted into the end of the segment and then into the connector to form the joint.

The curved rim and basket members support interlaced strands 26, which extend vertically and horizontally so as to form a basketwork which spans the gaps between the supports. The strands, which may suitably be formed of ¼-inch flexible PVC or polyethylene plastic rod, are threaded through corresponding bores in the basket and rim members, with the junctions 28 between the strands being secured using a small ties, straps, sleeves, clips or other suitable connectors.

A vertical pillar tube 20 extends downwardly from the basket structure for attachment to an underlying support. In the embodiment which is illustrated, the support is provided by the stand structure 16, although it will be understood that in other embodiments the support may be a post or socket which is mounted to the ground for engaging the pillar tube, or the pillar tube itself may be cemented or otherwise mounted directly to the ground or other substrate.

The stand 16 is somewhat similar in construction to the basket structure described above, in that this made up of a plurality of outwardly and downwardly arched tubular leg members 30*a–d* which extend radially from a vertical center tube 32. The upper end of tube 32 is mounted in coaxial alignment with pillar tube 20 by means of a connecting sleeve 34, so that the two sections can be separated for transportation or storage.

At their lower ends, the leg members 30*a–d* are mounted to a generally circular base ring 38 which is formed of a plurality of curved rim members 36*a–d*. As with the members described above, the leg and rim members are joined by means of suitable pipe connectors, although three-legged "T" connectors 40*a–d* are used rather than the four-way connectors described above. The leg members and a base ring thus provide a broad, stable support for the upper portions of the target assembly.

Turning now to the disc interception structure 14, it can be seen that this includes a plurality of tubular support members 44*a–d* which extend upwardly and somewhat outwardly from the circular rim of the basket structure, and then arch back inwardly over the top of the assembly. The lower ends of the support members are inserted into the upper end of the pillar tube 22, while the upper ends of the support members arch upwardly and outwardly and are mounted to a generally circular upper rim 46 by T-connectors 48. The arched support members 44*a*–44*d* thus define a large, somewhat vase shaped capture area 52 for receiving flying discs.

A plurality of vertical chains 54, in turn, are suspended from the upper rim 46 for intercepting discs which enter the capture area, the spacing between adjacent chains being somewhat less than the diameter of the discs with which the target is intended to be used. As can be seen in FIG. 1, the lower ends 64 of the chain segments are then secured around the bottom of the support members, using a flexible rod 66 or other suitable tie or member.

As is also shown in FIG. 9, additional flexible rods may be threaded through the chain segments between the upper and lower ends thereof so as to form horizontally extending, outwardly-biased retaining rings 68–70. The rods are suitably formed of a somewhat rigid but still resiliently flexible material, such as the ¼-inch flexible plastic rod material described above. The flexible retaining rings help maintain the shape of the interception structure, and also serve a function similar to that of the horizontal chain segments described above, i.e., these maintain a degree of cohesion between the chain segments and prevent the segments from spreading apart when struck by a disc.

b. Disc Capture

The target assembly of the present invention possesses superior disc capture characteristics, by virtue of the combination of chain segments and curved, tubular support members which make up the interception structure of the assembly.

As was noted above, the upper support members 44*a–d* are arched/curved in an upward and outward direction when a disc 110 enters this structure, as indicated by arrow 114, and it is more likely to initially strike one of the chain segments than one of the support members. As the chain segments deflect inwardly under the impact, however, the disc impacts one or more of the curved support members 44*a–d*, so that the curved surfaces thereof cause the disc to cant or tilt to one side or the other as it is deflected by the member. This abrupt change in direction interrupts the gyroscopic motion of the disc and reduces its kinetic energy. After the momentum of the disc has been dissipated by the curved support member, it is easily arrested by the chain members and drops into the basket structure of the assembly. Moreover, the absence of any large, flat or continuous surfaces on the support members greatly reduces the chance of the disc bouncing back out of the assembly in the event that it strikes one of the members head-on. Also, should the disc happen to pass between the chain segments on one side of the structure (as may happen when the disc is flying at an angle), it will strike the curved support members and be intercepted by the chain segments on the opposite side of the assembly.

c. Energy-Absorbing Attachment Loops

FIGS. 2–8 illustrate the structure and operation of a disc golf target in accordance with another embodiment of the present invention, which incorporates a structure for supporting the chains so as to absorb additional kinetic energy from a disc that strikes the target assembly.

Figure 2:
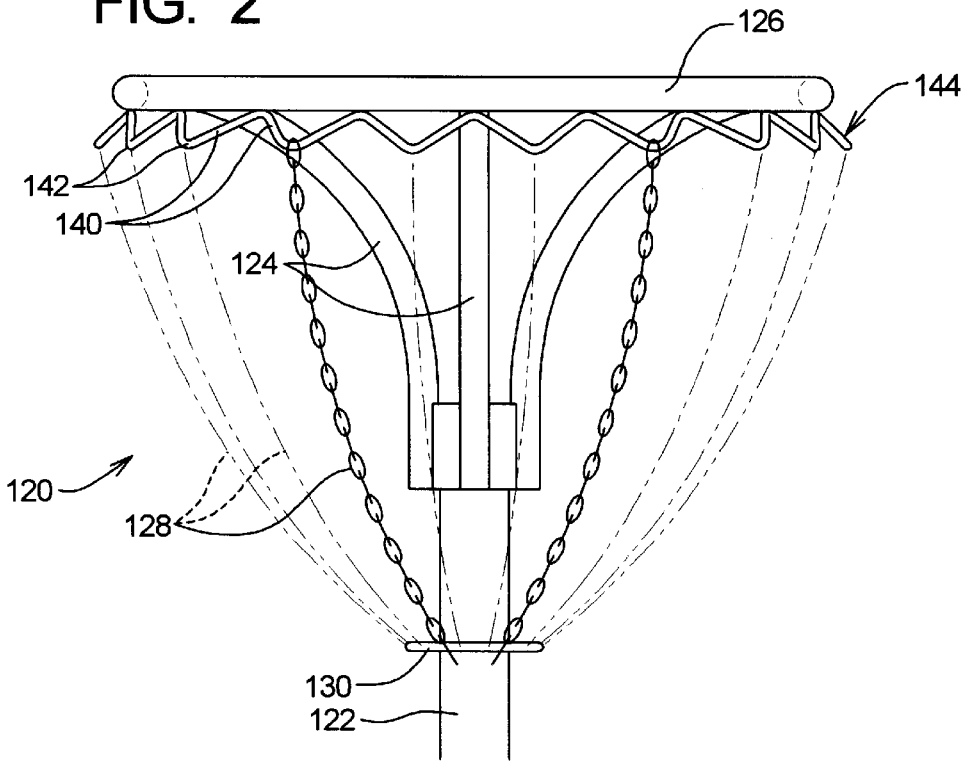
FIG. 2 is an elevational view of the disc interception portion of a target assembly in accordance with a second embodiment of the present invention, which includes a series of V-shaped connections for the upper ends of the chain members that are supported from the upper rim of the assembly, so as to aid in dissipating the kinetic energy of a moving disc that strikes the target assembly.
Figure 3:
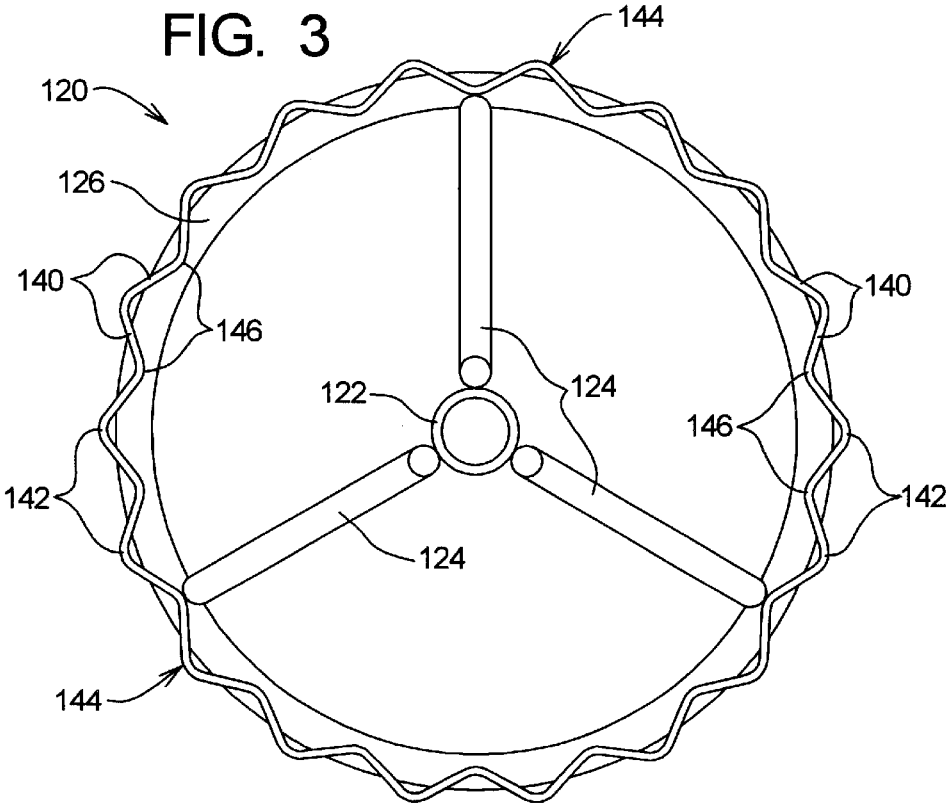
FIG. 3 is a bottom, plan view of the disc interception structure of claim 2, showing the manner in which the series of V-shaped attachment points is formed and mounted along the lower edge of the upper rim member of the assembly.

As can be seen in FIG. 2, the assembly 120 is somewhat similar to that described above, in that there is a central support tube 122 and a plurality of upwardly and outwardly curved support members 124, with a circular rim member 126 being mounted to the upper ends of the support members. A plurality of chain segments 128 are supported from the rim member 126 for intercepting the discs, with the lower ends of the chains being gathered and joined around the support post 122 by a ring member 130. The illustrated embodiment is preferably constructed of tubular, welded steel, however, as indicated above, plastic tubing or any other suitable material may be employed.

In the embodiment of the invention that is shown in FIG. 2, the chain segments 128 are attached to a series of depending loops 140, rather than directly to the rim member. As can be seen, each of the attachment loops is generally U-shaped, so that the upper link of the chain segments rest at the bottom 142 thereof when the chain is in a static condition.

The attachment loops 140 can suitably be formed as part of a continuous rod 144, bent to shape and welded or otherwise mounted to the rim member 126 at the intervening vertices 146. The number and size of the attachment loops depends on the size of the rim member and also the number and intended spacing of the chain segments which are suspended therefrom; for example, an assembly having a 21-inch outside diameter upper rim may suitably be provided with 18 attachment loops (the outwardly-angled bottom ends of the loops being spaced about 3¾-inch apart) so as to give a suitable spacing and pattern of chains for use with most of the sizes of discs.

Figure 4:
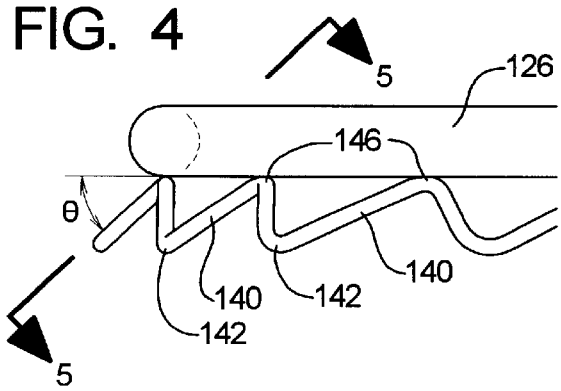
FIG. 4 is a partial, elevational view of an edge of the upper rim member of the target assembly of FIGS. 2–3, showing the downward and outward angulations of the V-shaped attachment loops thereon.
Figure 5:
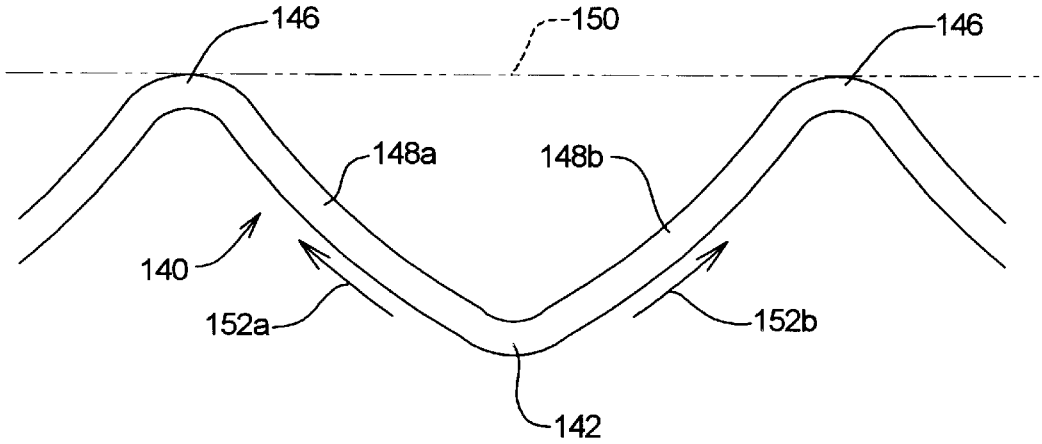
FIG. 5 is an elevational view, taken along line 5—5 in FIG. 4, showing the generally V-shaped configuration of the attachment loops in greater detail.

FIGS. 4–5 show the configuration of the chain attachment loops in greater detail. As can be seen in FIG. 4, each of the loops extends downwardly and outwardly from the rim 126 at an angle θ, which is preferably about 45°. Consequently, the outer ends 142 of the attachment loops project somewhat beyond the outer edge of the rim member 126, e.g., by about ½-inch in the embodiment which is illustrated.

As is shown in FIG. 5, each of the U-shaped attachment loops is preferably somewhat rounded, so that there are first and second outwardly curved segments 148*a*, 148*b* extending upwardly on either side of a more V-shaped bottom section 142. The vertices 146 on either side of the attachment loop, in turn, lie in a common plane 150, for welding or other attachment to the underside of the rim member 126.

The rod material of which the attachment loops are formed is generally cylindrical and smooth sided, so as to permit the upper link of each chain to slide cleanly thereon without obstruction; when fabricated of steel, the attachment loops may suitably be formed of 5/16-inch wire rod. The somewhat V-shaped bottom portion of each loop helps to "center" the chain, i.e., it helps to return and maintain the chain in its initial, static orientation. When the chain is struck by a disc, however, this causes the top link of the chain to be displaced from the bottom of the attachment loop, so that the link slides up one or the other of the two side legs 148*a*, 148*b* as indicated by arrows 152*a*, 152*b* in FIG. 5. As this is done, the main length of the chain is raised upwardly (i.e., in the direction towards plane 150 in FIG. 5), which upward movement is resisted by the weight of the chain. At the same time, the upper end of the chain moves somewhat inwardly, i.e., inwardly toward the center of the assembly. The chain thus yieldedly resists the impact of the disc, with the force of the impact being transferred to and dissipated by the lifting motion of the chains. Furthermore, the preferred outwardly-curved (as opposed to linear) configuration of the side legs 148*a*, 148*b* means that the resistance that is offered by the chain increases as the upper link of the chain slides upwardly along the sides of the loop, being that a given amount of lateral displacement yields a greater increase in height as the chain moves towards the end of the curved sides of the loop. This progressive increase in resistance serves to effectively slow and absorb the energy of the disc, and also helps to reduce the extent to which the chains slam into the rim member at the upper ends of the loop. It will be understood, however, that in some embodiments the side legs of the attachment loops may be straight, or may have a polygonal shape or other form.

Figure 6:
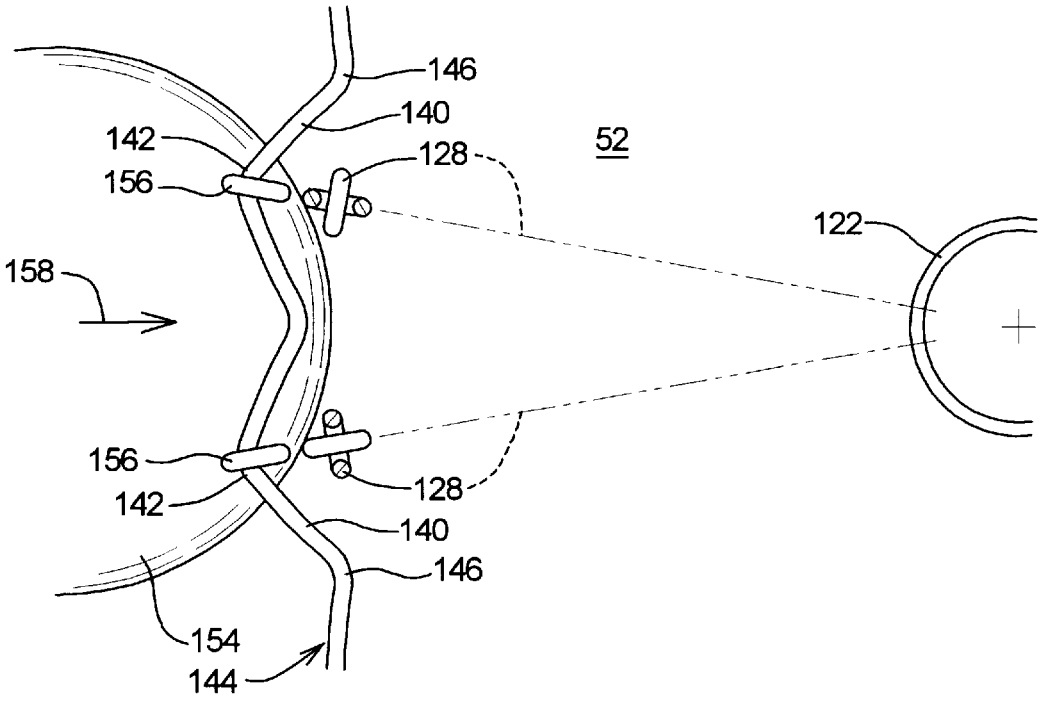
FIGS. 6–8 are a sequential series of top, plan views, illustrating the manner in which the chains spread apart as they are impacted by a moving disc which is intercepted by the structure, and the manner in which the ends of the chains spread apart and ride up the inclined sides of the V-shaped attachment loops so that the weight of the chains helps to absorb and dissipate any energy of the disc as it enters the capture zone of the target assembly.
Figure 7:
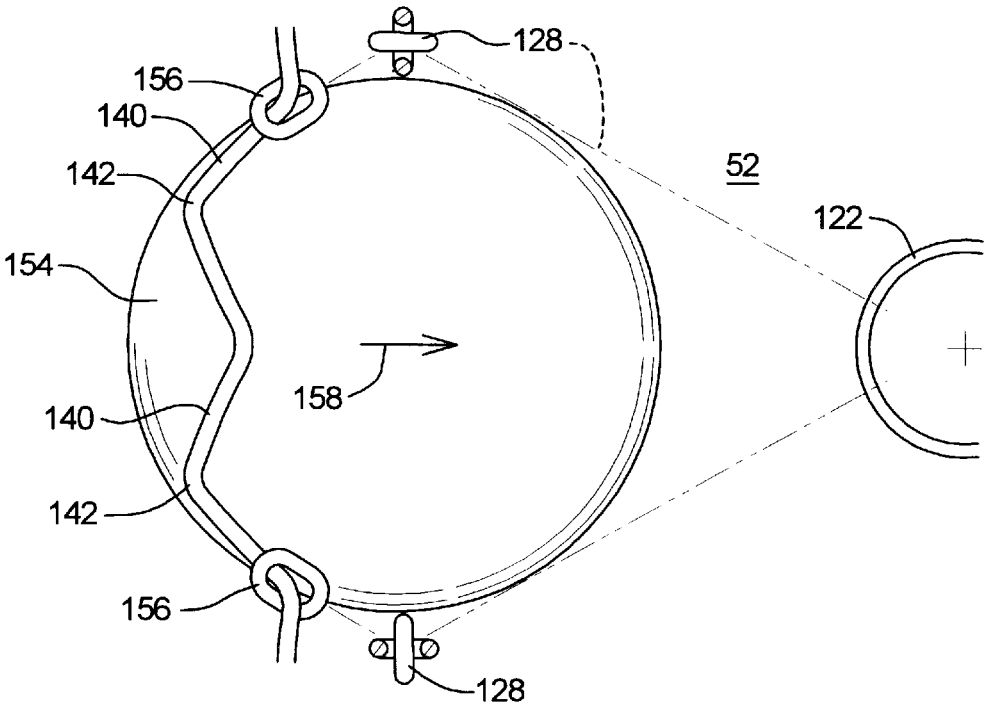
Figure 8:
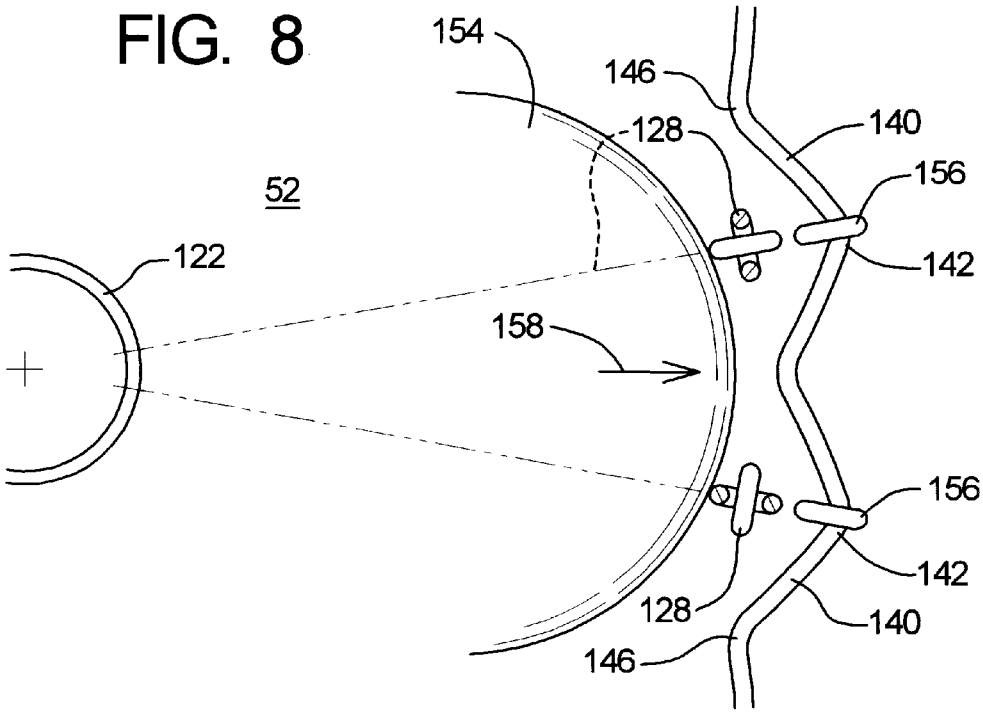

FIGS. 6–8 show the manner in which a disc impacts and passes through the chains that are suspended from the angled attachment loops 140. A can be seen, FIG. 6 shows the moment of initial contact between the target assembly and the disc 154, at which point the chains are hanging from the attachment loops 140 in their initial, static positions, with the upper links 156 of the chains resting in the bottom portions 142 of the attachment loops.

Following impact, continued forward motion of the disc in the direction indicated by arrow 158 drives the two depending chains 128 apart, causing their upper links to slide upwardly and inwardly along the sides of the attachment loops (see FIG. 7). As was explained above, this causes the kinetic energy of the disc to be absorbed in the spreading and lifting of the chains from their initial, static positions. The disc is consequently slowed and rendered easier to capture when it subsequently strikes one of the supports 124, in the manner which has been described above. It will be understood that if the disc strikes one of the chains in a more head-on fashion than that which is shown in FIGS. 6–7, the resistance of the chain and the circular shape of the disc will ordinarily cooperate to move the disc to the orientation that is shown in FIG. 6.

Once the disc passes through and enters the capture area 52, the weight of the chains causes them to move back together behind the disc and return to the positions shown in FIG. 6. This helps to prevent the disc from flying back out of the capture area. For example, should the disc somehow fail to strike the supports and continue in the direction of arrow 158 to the opposite side of the capture area, the disc will strike the inner sides of the chains 128 in that area and so be restrained against escaping. In this case, since the lower ends of the attachment loops are pointed outwardly, the impact force will not cause the chains to slide upwardly along the sides of the loops; instead, the somewhat V-shaped bottom portions of the attachment loops serve to hold the chains in position and prevent them from spreading apart, thereby helping to retain the disc in the capture area. The same would occur if the disc were to bounce off of the structure and return along the path by which it entered the capture area.

It will be understood that the energy-absorbing structure which is shown in FIGS. 4–8 may be employed with other forms of target assemblies, in addition to the embodiment having upwardly and outwardly curved support members and a circular rim member which is shown in FIG. 2. For example, the arrangement of attachment loops and chains may be supported from any suitable structure, such as any of a variety of curved or rectilinear supports or rim members, or even individual support members. Furthermore, it will be understood that although linked chain such as that which is shown in the figures has numerous advantages in terms of durability, low cost, ease of installation, and so on, any suitable form of elongate, generally vertical member may be used, such as a length of rope or cable, for example, and to which a weight or tension member may be attached if necessary. Still further, it will understood that the attachment loops may have other configurations in addition to those which has been shown herein, so long as the desired lifting of the chain or other member is achieved upon a disc striking the target assembly.

It is therefore to be recognized that various alterations, modifications, and/or additions may be introduced into the constructions and arrangements of parts described above without departing from the spirit or ambit of the present invention.

What is claimed is:

1. A disc golf target assembly, comprising:

at least first and second elongate, generally vertical members disposed to form a barrier with respect to a path of a disc; and attachment members by which upper ends of said vertical members are suspended from a support structure;

each of said attachment members comprising a downwardly extending portion from which said vertical member hangs when in a static condition, and upwardly sloped side portions extending generally laterally from said downwardly extending portion up which said vertical member slides in response to being struck by a disc;

so that kinetic energy of a disc is absorbed and dissipated in lifting said vertical members and spreading said vertical members laterally apart as a disc strikes said target assembly.

2. The target assembly of claim 1, wherein said attachment members comprise:

a plurality of generally U-shaped attachment loops.

3. The target assembly of claim 2, wherein said support structure comprises:

an elongate rim member mounted along upper edges of said attachment loops.

4. The target assembly of claim 3, wherein said elongate, generally vertical members comprise:

a plurality of elongate, flexible members having sufficient weight to return said vertical members to said static position after being struck by a disc.

5. The target assembly of claim 4, wherein said plurality of elongate flexible members comprises:

a plurality of chain segments suspended from said attachment loops.

6. The target assembly of claim 5, wherein said side portions of said attachment members comprise:

side portions of said attachment loops, said side portions of said attachment loops having an outward and upward curvature so that said weight of said chain segments offers increasing resistance to said disc as said chains spread further apart in response to being struck by said disc.

7. The target assembly of claim 6, wherein said downwardly extending portions of said attachment members comprise:

a generally V-shaped portion of said attachment loops for centering said chain segments in said attachment loops when said chain segments are in said static position.

8. The target assembly of claim 5, wherein said elongate rim member comprises:

a rim member which extends about a perimeter of a capture area.

9. The target assembly of claim 8, wherein said chain segments are suspended along said rim member so as to substantially surround said capture area.

10. The target assembly of claim 9, wherein said downwardly extending portions of said attachment loops are angled outwardly about said perimeter of said capture area, so that said chain segments slide rearwardly along said side portions of said attachment loops and towards said capture area in response to being struck by a disc which is entering said capture area.

11. The target assembly of claim 10, wherein said rim member is a circular support member extending continuously about said capture area.

12. The target assembly of claim 11, wherein said plurality of attachment loops are formed as a continuous structure that is mounted to said circular support member.

13. The target assembly of claim 12, wherein said continuous structure forming said attachment loops is a bent wire rod.

14. The target assembly of claim 13, further comprising:

a ring member interconnecting lower ends of said chain segments so that said chain segments extend downwardly and inwardly around said capture area.

15. A disc golf target, comprising:

a plurality of generally vertically extending chains forming a barrier with respect to a path of a disc, said vertically extending chains being spaced apart by a distance less than a predetermined diameter of said disc; and a plurality of attachment members from which upper ends of said chains are suspended, each of said attachment members comprising a generally U-shaped rod member that passes through an upper link of one of said vertically extending chains and has a downwardly extending vertex from which said chain hangs when in a static condition and first and second upwardly sloped side portions extending generally laterally from said downward vertex;

so that in response to a disc striking said barrier said upper links of said claims slide upwardly and laterally towards adjacent chains in said barrier so that kinetic energy of a disc is absorbed and dissipated in lifting said chains and spreading said chains laterally apart as a disc strikes and passes through said barrier.

16. A disc golf target assembly, comprising:

a plurality of elongate, flexible, generally vertical chain segments disposed to form a barrier with respect to a path of a disc, said chain segments having sufficient weight to return to a static position after being struck by a disc; and attachment members by which upper ends of said vertical chain segments are suspended from a support structure;

each of said attachment members comprising a generally U-shaped attachment loop having a downwardly extending portion from which one of said vertical chain segments hangs when in a static condition and upwardly sloped side portions up which said chain segment slides in response to being struck by a disc, said side portions of said attachment loops having an outward and upward curvature so that said weight of said chain segments offers increasing resistance to a disc as said chains spread further apart in response to being struck by a disc;

so that kinetic energy of a disc is absorbed and dissipated in spreading and lifting said vertical members as a disc strikes said target assembly.

17. The target assembly of claim 16, wherein said bottom portions of said attachment members comprise:

a generally V-shaped portion of said attachment loops for centering said chain segments in said attachment loops when said chain segments are in said static position.

18. A disc golf target assembly, comprising:

a plurality of elongate, flexible, generally vertical chain segments disposed to form a barrier with respect to a path of a disc, said chain segments having sufficient weight to return to a static position after being struck by a disc;

an elongate rim member extending about a perimeter of a capture area, said chain segments being suspended along said rim member so as to substantially surround said capture area; and a plurality of generally U-shaped attachment loops by which upper ends, of said chain segments are suspended from said rim member, said attachment loops being formed as a continuous structure by a bent wire rod that is mounted to said elongate rim member;

each of said attachment loops comprising a downwardly extending portion from which one of said chain segments hangs when in a static condition and upwardly sloped side portions up which said chain segment slides in response to being struck by a disc, said bottom portions of said attachment loops being angled outwardly about said perimeter of said capture area so that said chain segments slide rearwardly along said side portions of said attachment loops and towards said capture area in response to being struck by a disc which is entering said capture area;

so that kinetic energy of a disc is absorbed and dissipated in spreading and lifting said vertical members as a disc strikes said target assembly.

19. The target assembly of claim 18, further comprising:

a ring member interconnecting lower ends of said chain segments so that said chain segments extend downwardly and inwardly around said capture area.

* * * * *